US009631448B1

(12) United States Patent
Rytlewski

(10) Patent No.: US 9,631,448 B1
(45) Date of Patent: Apr. 25, 2017

(54) DISTIBUTED CONTROL SYSTEM FOR WELL APPLICATION

(71) Applicant: Schlumberger Technology Corporation, Sugar Land, TX (US)

(72) Inventor: Gary Rytlewski, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/227,250

(22) Filed: Aug. 3, 2016

(51) Int. Cl.

| | |
|---|---|
| ***E21B 33/064*** | (2006.01) |
| ***E21B 34/04*** | (2006.01) |
| ***E21B 33/035*** | (2006.01) |
| ***E21B 33/06*** | (2006.01) |
| *E21B 34/00* | (2006.01) |

(52) U.S. Cl.
CPC ..... *E21B 33/0355* (2013.01); *E21B 33/063* (2013.01); *E21B 33/064* (2013.01); *E21B 34/04* (2013.01); *E21B 34/045* (2013.01); *E21B 2034/002* (2013.01); *E21B 2034/005* (2013.01)

(58) Field of Classification Search
CPC .. E21B 33/0355; E21B 33/063; E21B 33/064; E21B 34/04; E21B 34/045; E21B 2034/002; E21B 2034/005
See application file for complete search history.

(56) References Cited

U.S. PATENT DOCUMENTS 6,125,938 A * 10/2000 Garcia-Soule ..... E21B 34/045 166/336
6,343,654 B1 * 2/2002 Brammer ..... E21B 33/0355 166/338
7,301,472 B2 * 11/2007 Kyle ..... E21B 47/14 181/103
7,938,189 B2 * 5/2011 Rytlewski ..... E21B 34/14 166/317
8,393,397 B2 * 3/2013 Trewhella ..... E21B 17/06 166/340
8,511,389 B2 * 8/2013 Fenton ..... E21B 33/0385 166/250.01
8,708,054 B2 * 4/2014 Dailey, Jr. ..... E21B 33/0355 166/250.01
8,725,302 B2 * 5/2014 Niemeyer ..... E21B 33/0355 700/275
8,800,662 B2 * 8/2014 Miller ..... E21B 33/0355 166/250.01
8,839,868 B2 * 9/2014 Scranton ..... E21B 34/045 166/360
2005/0217845 A1 * 10/2005 McGuire ..... E21B 34/045 166/100
2011/0297387 A1 * 12/2011 Hart ..... E21B 33/0355 166/345

* cited by examiner

*Primary Examiner* — Matthew R Buck
(74) *Attorney, Agent, or Firm* — Tuesday Kaasch

(57) ABSTRACT

A technique facilitates control over flow of hydraulic actuating fluid used to perform a plurality of actuating functions in a subsea well application. A control module is employed for controlling a plurality of hydraulically controlled components and is located along a subsea test tree at a position relatively close to the hydraulically controlled components. The control module, in turn, is controlled electronically via an electric line which provides electric control signals corresponding to desired control instructions regarding the hydraulically controlled components. By moving the control module closer to the hydraulically controlled components response time is greatly reduced.

20 Claims, 4 Drawing Sheets

DISTIBUTED CONTROL SYSTEM FOR WELL APPLICATION

BACKGROUND

In a variety of subsea well applications, a blowout preventer is positioned at a subsea well. Once positioned, the blowout preventer is able to receive many types of subsea equipment, such as a subsea test tree, tubing hanger running tool, and downhole completion equipment. Components of the subsea equipment are controlled via electrohydraulic controls located in a module above the subsea test tree. A dedicated hydraulic control line is used for each operating tool function, and thus a relatively large number of hydraulic control lines, e.g. 20-26 or more, may be routed from the module to the corresponding tool or component. Running this number of control lines can be extremely costly due to the use of hoses, hydraulic lines, and gun drilling through various parts to form the independent hydraulic control conduits.

The hydraulic control lines also may be routed over substantial lengths between the module and the component being hydraulically controlled. As a result, the response times can be slowed. In many applications, the subsea test tree includes a failsafe valve which is operated hydraulically and should be able to close as rapidly as possible in an emergency situation. The relatively long hydraulic control lines cause the control fluid to pass through an extensive flow path to pressurize the close control piston and to vent the open control piston of the failsafe valve, thus slowing the response time of the valve. The long hydraulic control lines also can be crimped during an emergency shearing operation, thus preventing venting of the pressure to enable closure of the failsafe valve.

SUMMARY

In general, a system and methodology facilitate control over flow of hydraulic actuating fluid used to perform a plurality of actuating functions in a subsea well application. A control module is employed for controlling a plurality of hydraulically controlled components and is located along a subsea test tree at a position relatively close to the hydraulically controlled components. The control module, in turn, is controlled electronically via an electric line which provides electric control signals corresponding to desired control instructions regarding the hydraulically controlled components. By moving the control module closer to the hydraulically controlled components response time is greatly reduced.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
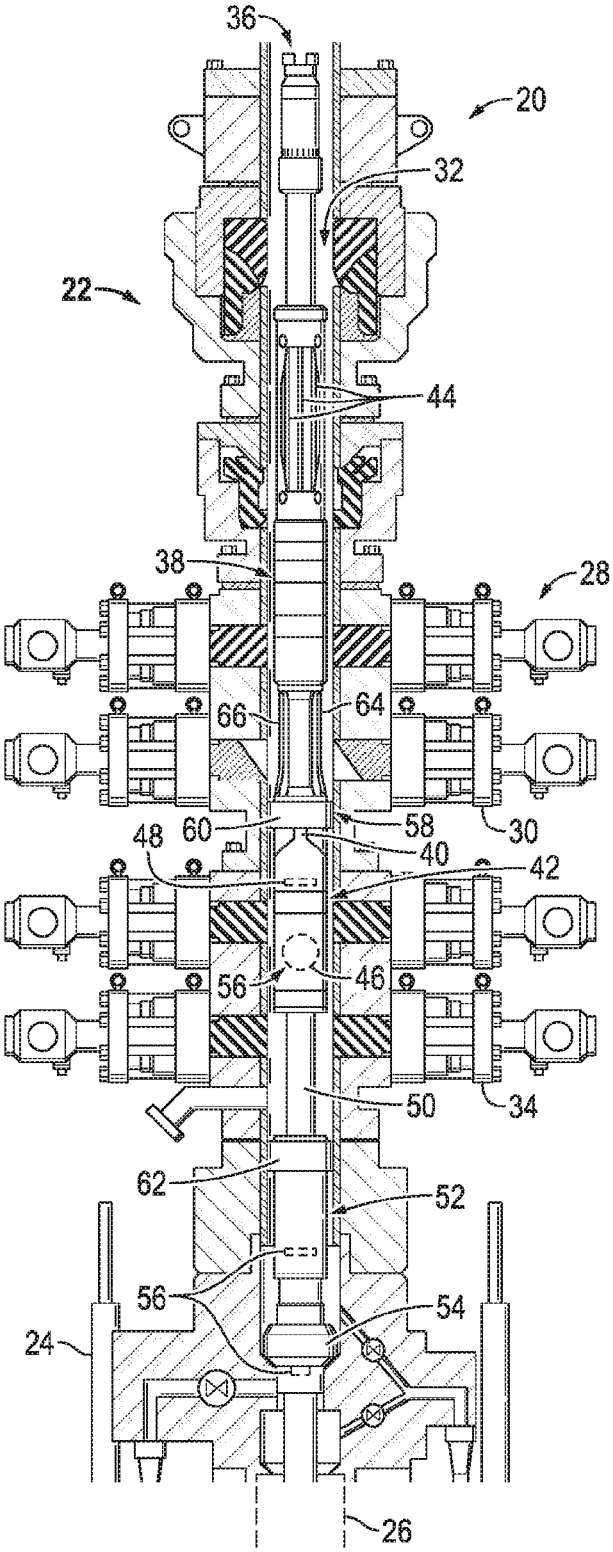
FIG. 1 is a schematic illustration of an example of a subsea system utilizing a subsea test tree having at least one control module positioned along the subsea test tree, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate the hydraulic actuation of a variety of components in a subsea well application. For example, the technique may be used to operate failsafe valves and other components in a subsea test tree and/or other subsea systems, such as completion systems and tubing hanger running tool systems. Control over operation of these components is moved closer to the hydraulically controlled components so as to reduce response times while also providing a less complex and less expensive structure.

According to an embodiment, a control module is employed for controlling a plurality of hydraulically controlled components. The control module is located along a subsea test tree at a position relatively close to the hydraulically controlled components. However, the control module is controlled electronically via an electric line which carries electric control signals corresponding to desired control instructions regarding the hydraulically controlled components. By using the electric line to place the control module closer to the hydraulically controlled components the actuating fluid travel path and thus the response time is greatly reduced. Additionally, a large number of the dedicated hydraulic control lines otherwise routed down through or along the subsea test tree in a conventional control system may be replaced with the electric line. With a hydraulically controlled failsafe valve, the control module may be constructed such that severing of the electric line results in automatically shifting of the failsafe valve to the desired failsafe position, e.g. closed position.

In some embodiments, the overall control system redistributes the actuating fluid control valves to at least one location, e.g. two or three locations, closer to tool function ports. By moving the actuating fluid control valves, a simplified hydraulic supply and electric supply may be used to provide hydraulic power and electrical control, respectively. This simplified structure minimizes the number of hydraulic feed throughs that would otherwise be employed along sections of, for example, a subsurface test tree and a tubing hanger running tool.

In some applications, the control module containing the actuating fluid control valves may be installed on top of a latch used in the subsea test tree. This allows the control module to be retrieved in case of a failure without removing the failsafe valve portion of the subsea test tree. In such an embodiment, the conventional hydraulic control lines can be replaced with a reduced number of control lines, e.g. a single control line, to supply hydraulic pressure to the control module. By way of example, the single control line may be in the form of a metal tube able to withstand high internal pressures.

It should be noted the metal tube may be crimped during an emergency situation in which the subsea test tree is sheared by shear rams of the blowout preventer. However, the failsafe valves are still allowed to close. For example, the control module may be constructed and positioned to enable venting of a flow of fluid beneath the latch to ensure closing of failsafe valves. In this example, the failsafe valves are able to close without fluid flow through the metal tube above the latch.

Placement of the actuating fluid control valves close to the failsafe valves (and other hydraulically actuated components) also decreases the response time. Consequently, the failsafe valves are able to close rapidly during, for example, an emergency situation. The control module system also may utilize a plurality of control modules distributed along the subsea test tree to further enhance rapid response times with respect to actuation of a variety of components.

By way of example, independent control modules, e.g. control module rings, may be located along, for example, a retainer valve and/or a slick joint associated with the subsea test tree. By distributing the hydraulic component control to a plurality of regions, the cost of providing independent control fluid conduits also is reduced. Additionally, various control line weak points may be eliminated so as to increase the reliability of the subsea test tree and related systems. In some applications, control components may be placed below a pipe ram of the blowout preventer or even below the wellhead.

Referring generally to FIG. 1, an example of a subsea well system 20 is illustrated. In this embodiment, the subsea well system 20 comprises a blowout preventer 22 which may be mounted above subsea equipment 24, such as a wellhead and/or Christmas tree. The subsea equipment 24 is positioned over a borehole 26, e.g. a wellbore. Depending on the application, the blowout preventer 22 may comprise a variety of components, such as a plurality of blowout preventer rams 28. The blowout preventer rams 28 may comprise, for example, a set of shear rams 30 positioned to shear through equipment disposed along an interior passageway 32 of the blowout preventer 22 in the event of an emergency. The blowout preventer rams 28 also may comprise other types of rams, such as a set of pipe rams 34.

In the example illustrated, a subsea test tree 36 is deployed down into blowout preventer 22 along interior passageway 32. The subsea test tree 36 may comprise an upper valve section 38 located above a latch 40 and a lower valve section 42 located below the latch 40 when the subsea test tree 36 is positioned within blowout preventer 22. By way of example, the upper valve section 38 may comprise a plurality of valves, such as a bleed off valve, a retainer valve, and other hydraulically controlled components which may be hydraulically controlled via a plurality of upper hydraulic lines 44. It should be noted that the number, arrangement, and type of valves disposed in upper valve section 30 may vary depending on the parameters of a given subsea operation.

Below latch 40, the subsea test tree 36 comprises lower valve section 42 having at least one failsafe valve 46. Failsafe valve 46 may be in the form of a ball valve or other suitable valve. In some embodiments, an additional valve or valves 48, e.g. a flapper valve, also may be positioned below latch 40. The flapper valve 48 may be in the form of a failsafe valve. By way of example, both the ball valve 46 and the flapper valve 48 may be constructed to automatically close to prevent fluid flow along the interior of subsea test tree 36 in an emergency situation. For example, shear rams 38 would be actuated in an emergency situation to shear through subsea test tree 36. Such shearing action would lead to the automatic closure of the failsafe valves, e.g. valves 46, 48.

Referring again to FIG. 1, additional types of equipment may be deployed into or through blowout preventer 22. By way of example, a slick joint 50 may be located below latch 40 and, in some applications, may extend downwardly from lower valve section 42. Additionally, a tubing hanger running tool 52 may be located below the slick joint 50 and a completion 54 may be suspended below the tubing hanger running tool 52. The equipment selected for a given operation, e.g. subsea test tree 36, slick joint 50, tubing hanger running tool 52, completion 54, may be deployed toward borehole 26 along interior passageway 32.

The subsea test tree 36, tubing hanger running tool 52, completion 54, an/or other deployed equipment may comprise hydraulically controlled components 56, such as failsafe valves 46, 48, located below latch 40. The hydraulically controlled components 56 may be selectively controlled via a distributed control system 58 comprising at least one control module 60. In some applications, an additional control module or modules 62 also may be incorporated into the deployed equipment at suitable locations, e.g. suitable locations below latch 40.

Instead of routing the relatively large number of upper hydraulic control lines 44 down through the length of the subsea test tree 36, a reduced number of hydraulic and electric lines are routed down to control module 60. For example, a single hydraulic line 64 may be used to deliver hydraulic actuating fluid under pressure to control module 60. Similarly, a single electric line 66 may be used to deliver electric control signals to control module 60 from a suitable control system, such as a surface-based computer control system. In some applications, hydraulic line 64 may comprise more than a single hydraulic line and, similarly, electric line 66 may comprise more than a single electric line. As referenced above, the hydraulic line 64 may be formed with metal tubing to enable higher internal pressures for enhanced testing and/or actuation procedures.

The control module 60 is electrically controlled via control signals routed through electric line 66 and comprises a plurality of directional control valves (as described in greater detail below) selectively actuated to control flow of hydraulic actuating fluid to the hydraulically controlled components 56. Accordingly, a plurality of relatively short actuating fluid hydraulic control lines may be routed through or along components of subsea test tree 36, joint 50, tubing hanger running tool 52, and/or completion 54 to accommodate the controlled flow of actuating fluid below control module 60. The shorter fluid travel paths from control module 60 enable rapid actuation of the selected, hydraulically controlled components 56, e.g. valves 46, 48, according to electrical control signals provided via electric line 66. In the event of an emergency actuation in which shear rams 30 are actuated to cut through electric line 66 and hydraulic line 64, the control module 60 is constructed to enable release of the hydraulic actuating fluid so that failsafe components, e.g. failsafe valves 46, 48, can automatically move to their failsafe positions, e.g. closed positions.

The additional control module(s) 62 also may be coupled with limited numbers of hydraulic lines 64 and electric lines 66, e.g. a single hydraulic line 64 and single electric line 66, to enable similar control of hydraulically controlled components 56 from a position closer to the controlled components. In the embodiment illustrated, the control module 60 is located below shear rams 30 when subsea test tree 36 is operationally positioned within blowout preventer 22. By way of example, control module 60 may be combined with latch 40 above the latch 40 or as part of the upper portion of latch 40. However, the control module 60 may be positioned at other locations above latch 40 or even below latch 40. Similarly, the additional control module 62 is illustrated as positioned between joint 50 and tubing hanger running tool 52. However, one or more control modules 62 may be located at other locations suitable for providing rapid response times with respect to the hydraulically controlled components 56 to which the additional control modules 62 are hydraulically connected.

Figure 2:
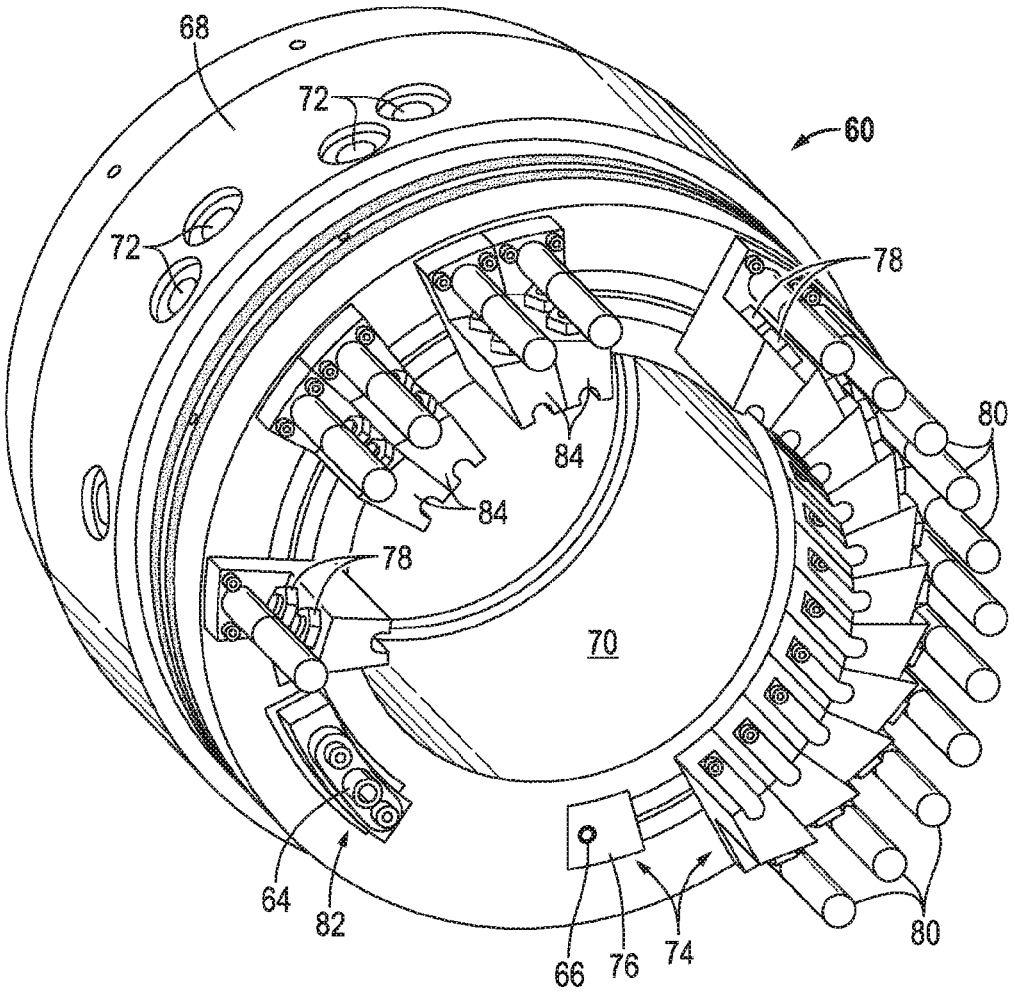
FIG. 2 is an illustration of an example of a control module which is electrically controlled so as to enable control over the selective flow of hydraulic actuating fluid to various well components, according to an embodiment of the disclosure.

Referring generally to FIG. 2, an embodiment of control module 60 is illustrated. In this example, control module 60 comprises a control module body 68 having an interior passage 70 therethrough. A plurality of electrically controlled valves 72 is mounted in control module body 68. By way of example, the electrically controlled valves 72 may be in the form of directional control valves received in control module body 68. As illustrated, the control module body 68 may be in the form of a ring with openings for receiving the directional control valves 72 in a generally radial orientation, however other orientations may be suitable for a variety of applications. The directional control valves 72 are selectively controlled to block flow or to enable flow of hydraulic actuating fluid to the corresponding hydraulically controlled components 56.

In the embodiment illustrated, valves 72 are controlled via an electrical control system 74 which may comprise, for example, an electrical controller 76, solenoids 78, and sensors 80. The electrical controller 76 may have a variety of forms and structures, but an example of electrical controller 76 comprises a circuit board to which electric line 66 is coupled. Control signals are routed to the control module 60 via electric line 66, and the electrical controller 76 is programmed to deliver the appropriate electric control signal to the appropriate solenoid or solenoids 78. The solenoids 78 are selectively operated to block or allow flow of actuating fluid to corresponding directional control valves 72 so as to actuate the corresponding directional control valve 72 to the desired flow or no-flow operational position.

The hydraulic actuating fluid is supplied to control module 60 under pressure via the hydraulic line 64 which may be coupled with control module 60 by a pressure supply connection 82. In some applications, a pair of solenoids 78 is associated with each corresponding directional control valve 72 so as to enable controlled opening or closing of the corresponding valve 72. The pairs of solenoids 78 may be mounted in corresponding solenoid housings 84.

In the embodiment illustrated, the solenoid housings 84 are received and mounted within the control module body 68 between interior passage 70 and an exterior of the control module body. In some applications, the sensors 80 may be in the form of pressure sensors employed to monitor pressure of the actuating fluid at each solenoid housing 84. However, sensors 80 may comprise a variety of sensors selected to monitor desired parameters related to actuation of the hydraulically controlled components 56. The sensors 80 may be used to output data to electrical controller 76 and/or a surface control system.

Figure 3:
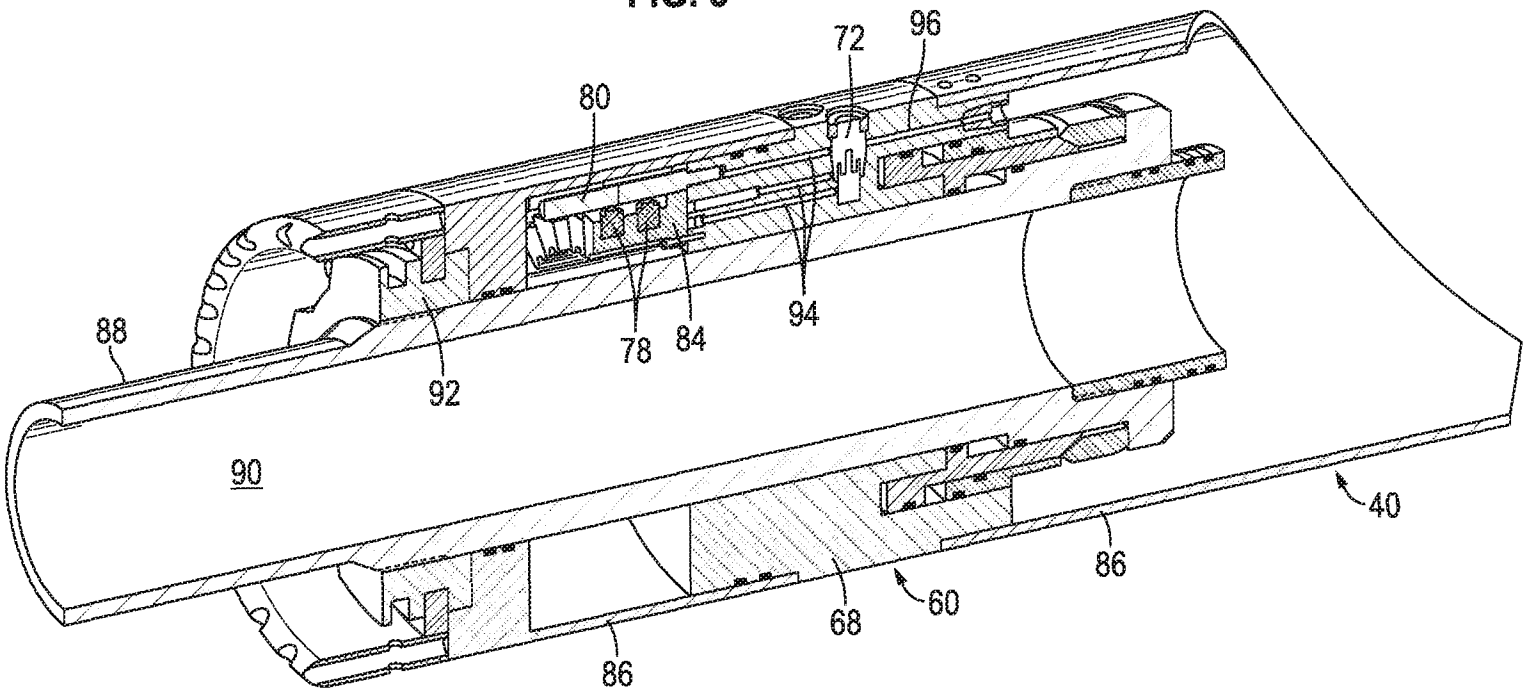
FIG. 3 is a cross-sectional view of an example of a control module positioned in a component of a subsea test tree, according to an embodiment of the disclosure.

With additional reference to FIG. 3, the control module 60 may be mounted to or incorporated into latch 40. In the example illustrated, the control module body 68 is engaged with a latch housing 86 by threaded engagement or other suitable engagement techniques. Additionally, a shear sub 88 having an interior passage 90 may be disposed through latch 40 and through control module 60 via interior passage 70. A suitable mounting structure 92 may be used to secure the shear sub 88 within latch 40 and control module 60. In this example, the solenoid housings 84, solenoids 78, and electrically controlled valves 72 are distributed around the shear sub 88.

As illustrated, the solenoid housings 84 and solenoids 78 are operationally coupled with corresponding directional control valves 72 via a series of flow lines 94. The flow lines 94 are arranged to cooperate with solenoids 78 such that electrical actuation of the solenoids 78 may be used to control flow of actuating fluid, supplied via hydraulic line 64, to the corresponding directional control valve 72. By actuating the appropriate solenoid 78 a flow of actuating fluid may be directed to the corresponding directional control valve 72 to open or close off flow of actuating fluid through the corresponding directional control valve 72. In this manner, electrical signals supplied via electrical control line 66 may be used to electrically control the valves 72.

When a given directional control valve 72 is shifted to an open flow position, hydraulic actuating fluid under pressure is able to flow along a downstream hydraulic control line 96 to the corresponding hydraulically controlled component 56. Accordingly, pairs of solenoids 78 may be electrically controlled to actuate the corresponding directional control valve 72 and thus the corresponding hydraulically controlled component 56. The number and arrangement of solenoids 78, directional control valves 72, and actuating fluid hydraulic control lines 96 may be selected according to the number and arrangement of hydraulically controlled components 56. As described above, the control modules 60, 62 may be located in relatively close proximity to the hydraulically controlled components, e.g. failsafe valves 46, 48, to ensure rapid response with respect to actuation of those components.

Figure 4:
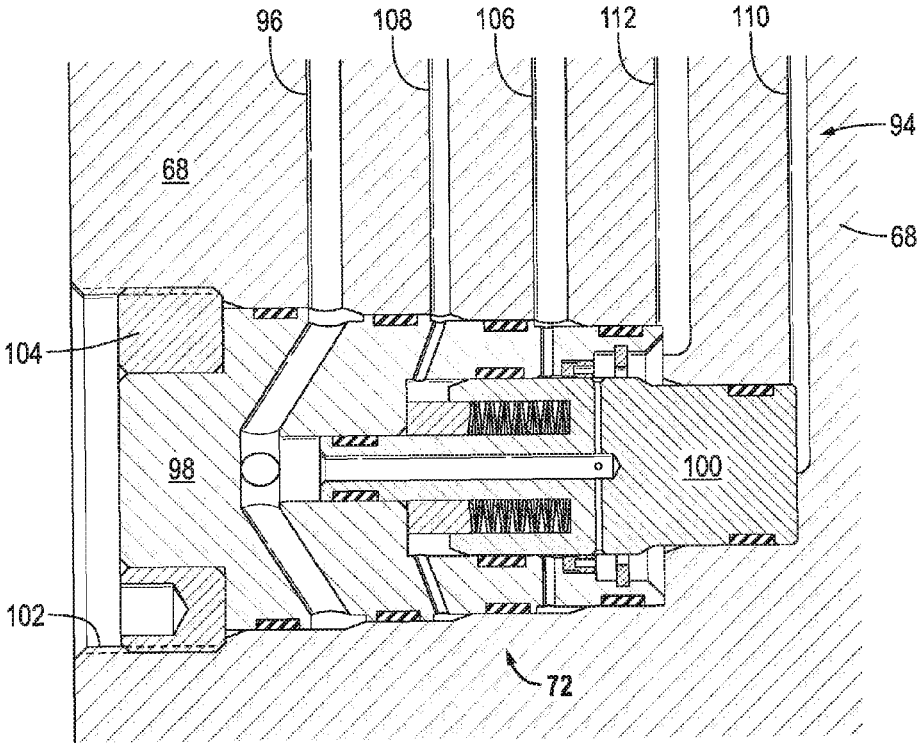
FIG. 4 is a cross-sectional view of an example of a directional control valve that may be used in the control module to selectively direct the flow of actuating fluid to a corresponding well component, according to an embodiment of the disclosure.

Referring generally to FIG. 4, an example of one of the directional control valves 72 is illustrated. In this example, the directional control valve 72 comprises a valve body 98 and a valve actuator 100 movably mounted within the valve body 98. The valve body 98 and valve actuator 100 are positioned in a recess 102 formed in control module body 68 and held in place by a retainer 104, e.g. a threaded retainer ring or fastener.

In the embodiment illustrated, the series of flow lines 94 extending between corresponding solenoids 78 and directional control valve 72 include a high pressure, actuating fluid supply line 106. Additionally, the series of flow lines 94 comprises a pilot-to-close line 108, a pilot-to-open line 110, and a drain line 112. Flow of high pressure actuating fluid to pilot-to-close line 108 or pilot-to-open line 110 is controlled via actuation of the corresponding solenoids 78 in their corresponding solenoid housing 84. The solenoids 78 are operated to ultimately enable or block flow of actuating fluid between hydraulic line 64 and actuating fluid supply line 106. In at least some applications, the drain line 112 may be ported to the outside diameter of the control module body 68.

When actuating fluid is allowed to flow to the pilot-to-close line 108, the valve actuator 100 is shifted with respect to valve body 102 so as to prevent flow of actuating fluid through valve 72 from supply line 106 to the downstream hydraulic control line 96. However, when the appropriate solenoids 78 are electrically actuated to allow actuating fluid to flow to the pilot-to-open line 110, the valve actuator 100 is shifted to an open flow position. In the open flow position, high pressure actuating fluid may flow from supply line 106, through the control valve 72, and out through the hydraulic control line 96. In the open flow position, high pressure actuating fluid continues to flow through control valve 72 and along hydraulic control line 96 to actuate the corresponding hydraulically controlled component 56. The directional control valve 72 may again be shifted to the closed position by providing the appropriate electrical signals to the corresponding solenoid or solenoids 78.

The additional control module or modules 62 may be constructed in the same or similar fashion to control module 60 described above. Use of the additional control module(s) 62 enables placement of solenoids 78 and directional control valves 72 relatively close to the components 56 being hydraulically controlled. The additional control modules 62 also greatly simplify the structure of the subsea test tree 36, tubing hanger running tool 52, and/or completion 54 by reducing the use of gun drilled flow passages and/or additional control line structures otherwise disposed along the equipment deployed within blowout preventer 22 and subsea equipment 24. For example, placing a control module 62 below the slick joint 50 enables control over hydraulic components located therebelow without drilling flow passages to accommodate flow of actuating fluid through the slick joint 50. This provides a technique for relatively inexpensive construction of slick joint 50 with a smooth exterior surface oriented for sealing engagement with pipe rams 34.

Similarly, location of the directional control valves 72 and solenoids 78 in control module 60 at a position below shear rams 30 also enables hydraulic control with a simplified structure, e.g. a single hydraulic line 64 and single electric line 66 routed past the shear rams 30 to the control module 60. If the control module 60 is used to control failsafe valves, such as valves 46, 48, the structure of the control module 60 described above allows the failsafe valves to vent and thus to close after a shear operation.

The size and structure of control modules 60, 62 as well as the hydraulically controlled components 56 may be adjusted according to the parameters of a given application. For example, control modules may be placed at a variety of locations along the equipment depending on the type and length of equipment and on the type and location of the hydraulically controlled components. Various types of subsea test trees, mandrels, slick joints, tubing hanger running tools, completions, and other components may be utilized in a given subsea operation. Similarly, the size and structure of the blowout preventer, wellhead, and/or other subsea equipment may be adjusted according to the parameters of the given subsea operation. The type of control signals as well as the type of downhole controller and/or surface controller also may be selected according to the parameters of the subsea operation and subsea environment.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea well application, comprising:

a subsea test tree having an upper valve section located above a latch and a lower valve section located below the latch, the subsea test tree further comprising a control module disposed between the upper valve section and the lower valve section, the control module comprising a plurality of electrically controlled valves and an actuation fluid supply connection, the plurality of electrically controlled valves being individually controllable via electrical input to direct hydraulic actuating fluid to a plurality of different devices located below the latch.

2. The system as recited in claim 1, further comprising a blowout preventer, the subsurface test tree being received in the blowout preventer.

3. The system as recited in claim 2, wherein the blowout preventer comprises a shear ram, the control module being located below the shear ram when the subsurface test tree is inserted into the blowout preventer for operation.

4. The system as recited in claim 1, further comprising a slick joint extending downwardly below the latch and a tubing hanger running tool disposed below the slick joint.

5. The system as recited in claim 4, further comprising an additional control module disposed beneath the slick joint.

6. The system as recited in claim 1, wherein the control module is disposed about a shear sub having an internal passage, the plurality of electrically controlled valves being disposed around the shear sub.

7. The system as recited in claim 1, wherein the electrically controlled valves comprise solenoids.

8. The system as recited in claim 1, wherein the electrically controlled valves comprise solenoids electrically operated to control flow of actuating fluid to corresponding directional control valves.

9. The system as recited in claim 1, wherein the control module comprises a control module body integrated into the latch.

10. A system, comprising:

a blowout preventer having a shear ram; and a subsurface test tree having a failsafe valve and a control module disposed below the shear ram when the subsurface test tree is received in the blowout preventer, the control module comprising:

a plurality of directional valves controlling flow of hydraulic actuating fluid to perform a plurality of hydraulic control functions including operation of the failsafe valve; and an electrical system coupled with an electrical control line to control the plurality of directional valves based on electrical signals received via the electrical control line.

11. The system as recited in claim 10, wherein the electrical system comprises a plurality of solenoids operationally coupled to the plurality of directional valves to control the operational positions of individual directional valves.

12. The system as recited in claim 10, wherein the subsurface test tree comprises an upper valve section located above a latch and a lower valve section located below the latch.

13. The system as recited in claim 12, wherein the control module is positioned between the upper valve section and the lower valve section.

14. The system as recited in claim 10, wherein a slick joint is located below the lower valve section and the blowout preventer comprises a pipe ram positioned for engagement with the slick joint.

15. The system as recited in claim 14, further comprising a tubing hanger running tool disposed below the slick joint.

16. The system as recited in claim 15, further comprising an additional control module positioned between the slick joint and the tubing hanger running tool.

17. A method, comprising:

coupling an electronically controlled module with a plurality of hydraulically controlled devices via a plurality of hydraulic control lines;

locating the electronically controlled module along a subsurface test tree such that the electronically controlled module is below a shear ram of a blowout preventer when the subsurface test tree is received in the blowout preventer;

using an electric line to provide electric control signals to the electronically controlled module; and controlling flow of hydraulic actuating fluid along the plurality of hydraulic control lines via the electronically controlled module according to the electric control signals.

18. The method as recited in claim 17, wherein controlling comprises controlling hydraulic actuation of the plurality of hydraulically controlled devices between different operational positions.

19. The method as recited in claim 18, wherein controlling comprises controlling a failsafe valve of the subsurface test tree, the failsafe valve being configured to fail to a closed position in the event the electric line is severed due to actuation of the blowout preventer shear ram.

20. The method as recited in claim 17, wherein using comprises using the electric line to provide electrical control signals to solenoids operatively coupled with directional control valves which, in turn, are positioned to control flow along the plurality of hydraulic lines.

* * * * *